US005105756A

United States Patent [19]

Bell

[11] Patent Number: 5,105,756

[45] Date of Patent: Apr. 21, 1992

[54] MINI-DECK FOR INSTALLATION IN SMALL FISHING BOAT

[76] Inventor: William M. Bell, 1152 Hwy. 31, Romance, Ark. 72136

[21] Appl. No.: 576,957

[22] Filed: Sep. 4, 1990

[51] Int. Cl.[5] ..... B63B 17/00

[52] U.S. Cl. ..... 114/363; 114/343; 297/250

[58] Field of Search ..... 114/343, 364, 363; 248/157, 161, 287; 297/250, 349

[56] References Cited

U.S. PATENT DOCUMENTS

| | | | |
|---|---|---|---|
| 2,107,629 | 2/1938 | Dallas | 248/188.2 |
| 2,436,862 | 3/1948 | Hiers | 248/188.2 |
| 2,557,972 | 6/1951 | Jewett | 114/363 |
| 2,712,349 | 7/1955 | Le Voir | 155/139 |
| 3,113,804 | 12/1963 | Ritter | 114/363 |
| 3,718,365 | 2/1973 | Gibson | 114/363 |
| 3,795,927 | 3/1974 | Darwin, Jr. et al. | 114/363 |
| 3,825,962 | 7/1974 | Grounds et al. | 114/363 |
| 4,281,426 | 8/1981 | Moeser | 114/363 |
| 4,391,006 | 7/1983 | Smith | 4/559 |

*Primary Examiner*—Edwin L. Swinehart
*Attorney, Agent, or Firm*—Hermann Investor

[57] ABSTRACT

A removably installed adjustable seat assembly for mounting at various positions within a small boat. The assembly provides an advantageous seating position for fishing, hunting and running a trolling motor. The seat assembly can be used in pairs at a front and rear of the boat to provide for comfortable seating for two in a advantageously spaced apart posture. The seat assembly is adjustable in two respects, an adjustable horizontal span between the seat and a nearest boat bench seat for abutting and supporting the assembly, and a level adjustment plate which adjusts relative height of the seat off of the boat's bottom. The assembly is secured to the boat by hose clamps tieing a stabilizer bar of the assembly to a rib of the boat. The assembly can also be installed with the seat directly over a bench seat of the boat, with the stabilizer bar tieing the assembly to the boat.

19 Claims, 2 Drawing Sheets

MINI-DECK FOR INSTALLATION IN SMALL FISHING BOAT

BACKGROUND OF THE INVENTION

The invention relates to a boat pedestal seat and a means of attachment which may be detachably fastened to at least one of the boat's ribs at a rear end and abutting and supported by an existing boat bench seat. In another embodiment, the pedestal seat can be located on top of an existing boat bench seat with an extending portion detachably fastened to one of the boat's ribs.

It is known in the art to provide a demountable or removable boat pedestal seat for small boats.

U.S. Pat. No. 2,712,349 to Cepull discloses a demountable boat chair wherein one side of the chair mounts to a transversely extending seat board of a row boat or the like while the other is attached to a supporting leg assembly hingedly connected to the opposite side edge of the seat for swinging movement between a first position collapsed against the under side of the seat, and a second position in which the assembly extends vertically downward from the seat to engage the boat bottom. Similarly, the back of the chair is hingedly attached such that the back may be folded down to make contact with the seat of the chair and folded for compact storage.

U.S. Pat. No. 3,113,804 to Reiter discloses a sliding swivel seat for attachment to the thwart of a boat. The invention has an elongated frame adapted to rest upon the thwart. This frame contains tracks extending along a substantial distance between the ends of the thwart and generally parallel to the edges of the thwart. A carriage which is mounted to the frame allows for movement of the seat along the tracks. The seat panel residing on the carriage has a means for allowing rotation of the seat about an axis perpendicular to the plane of the frame.

U.S. Pat. No. 3,718,365 to Gibson discloses a seat attachment for boats which includes a rectangular tubular main frame using clamps to detachably secure the frame to the sides of the boat. A sub-frame carrying a seat is telescopically engaged with opposed sides of the tubular main frame to permit sliding adjustment of the sub-frame longitudinally of the main frame. A chair attached to the sub-frame is allowed to rotate about an axis perpendicular to the plane of the main frame.

U.S Pat. No. 3,795,926 to Darwin, Jr. et al. discloses a seat support adapted to be selectively positioned on the gunnels of a boat through the use of adjustable extending gunnel clamps which are slideably held by the supporting frame.

U.S. Pat. No. 4,281,426 to Moeser discloses a boat seat mounting unit adapted to be clamped onto a boat thwart. Adjustable shoes are used which engage opposite sides of the thwart for clamping of the base to the thwart. The shoes are roughly adjusted to initially space the shoes apart a distance somewhat greater than the width of the thwart for application of the unit to the thwart.

U.S. Pat. No. 4,391,006 to Smith discloses a transfer bench for use in enabling an invalid to be moved, at least partially, into a bath tub. One side of the bench frame is attached to a side of the bath tub using clamping means. There is an entry bench, separate from the main bench, located at the end of the frame associated with the clamping means. The side of the frame opposite the clamping means is supported by a leg assembly which engages the bottom of the bath tub. Both the height of the unit and the width of the unit are adjustable by the user.

SUMMARY OF THE INVENTION

The present invention relates to a seat assembly selectively and removably installable into a small boat such as may be usable by fishermen or duck hunters and readily adjustable to fit a variety of boats, and/or a plurality of positions within a boat, thus giving a user better eye contact with the water, and easy access to a trolling motor.

The seat assembly of the present invention also provides seating arrangements for two people, is safe and secure and will not pull loose, and is flexibly adjustable to a plurality of elevations with respect to the boat.

More specifically a bridge like structure abuts and is supported by an existing bench seat in the boat at one end, and is secured to and supported by a floor structure of the boat at a second end.

A level adjustment plate adjusts height of the seat assembly off of the boat floor, and a length adjusting plate positions the seat assembly relative to the bench seat, thereby permitting installation at a rear of the boat and installation at a front of the boat.

A pedestal mounted at a top of the seat assembly, holds and positions a seat at an elevated position for better eye contact with the water, and easy access to a trolling motor for propelling the boat.

A stabilizing bar located at a bottom of the seat assembly adjacent to the floor of the boat, provides a support structure for the seat assembly and structure adjacent to a rib of the boat for anchoring the seat assembly to the rib of the boat, using just two hose clamps. The adjustment plates are telescopically adjustable into and out of a elbow plate for flexible adjustability of installation of the seat arrangement in a plurality of boats, or in a plurality of positions within any one boat.

A rotation platform is located between the pedestal and the seat and a bridge like structure of the seat assembly provides vertical support behind and in front of the user to prevent tipping.

DESCRIPTION OF THE PREFERRED EMBODIMENT

Figure 1:
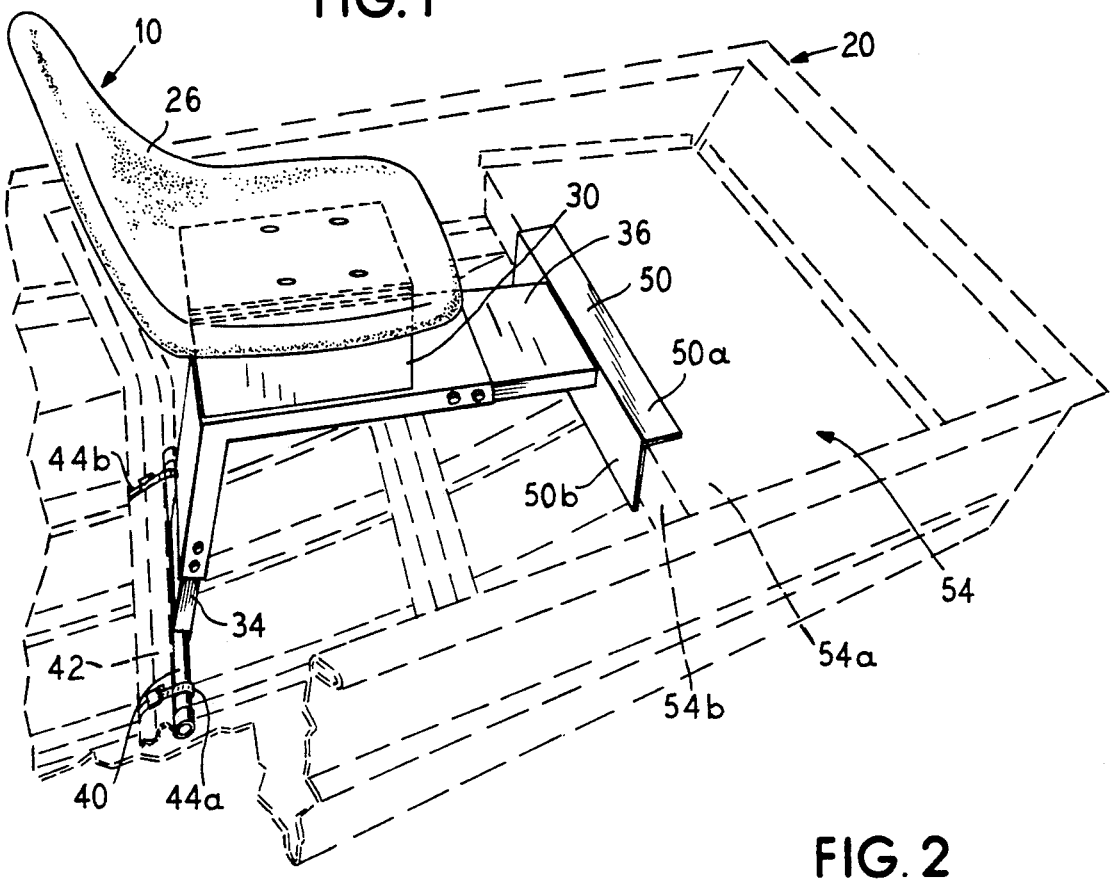
FIG. 1 is a perspective view showing a seat assembly mounted in a front portion of a boat.

FIG. 1 shows a seat assembly at 10 installed inside a small boat 20. The seat assembly comprises a seat 26 mounted onto a pedestal 30, the pedestal 30 mounted onto an elbow plate 32, which holds in telescopic fashion a level adjustment plate 34 and a length adjustment plate 36. The level adjusting plate 34 is attached to a stabilizing bar 40 which is attached to a rib 42 of the boat 20 by a first hose clamp **44*a* and a second hose clamp 44*b*. The length adjusting plate 36 is attached to an abutment and support plate 50 having a horizontal leg 50*a* and a vertical leg 50*b*. The abutment and support plate 50 engages a bench seat 54 of the boat 20. The horizontal leg 50***a* rests upon a top surface 54*a* of the seat 54, and the vertical leg 50*b* abuts a facing surface 54*b* of the seat 54.

Figure 2:
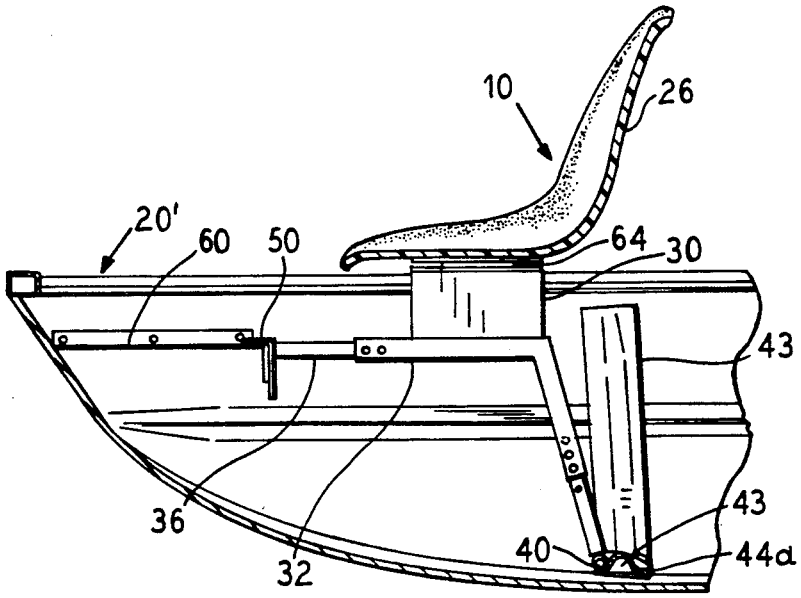
FIG. 2 is a sectional view of the seat assembly mounted to a front portion of the boat.

FIG. 2 shows the seat assembly mounted to a front area of the boat 20. The abutment and support plate 50 is now engaged to a front seat 60 and the stabilizing bar 40 is attached to a second rib 43. A rotational platform 64 is shown between the seat 26 and the platform 30, which provides an alternate embodiment providing a user with rotation of the seat 26 with respect to the pedestal 30. In this embodiment the seat 26 would be attached to the rotational platform 64 which would be attached to the platform 30.

Figure 3:
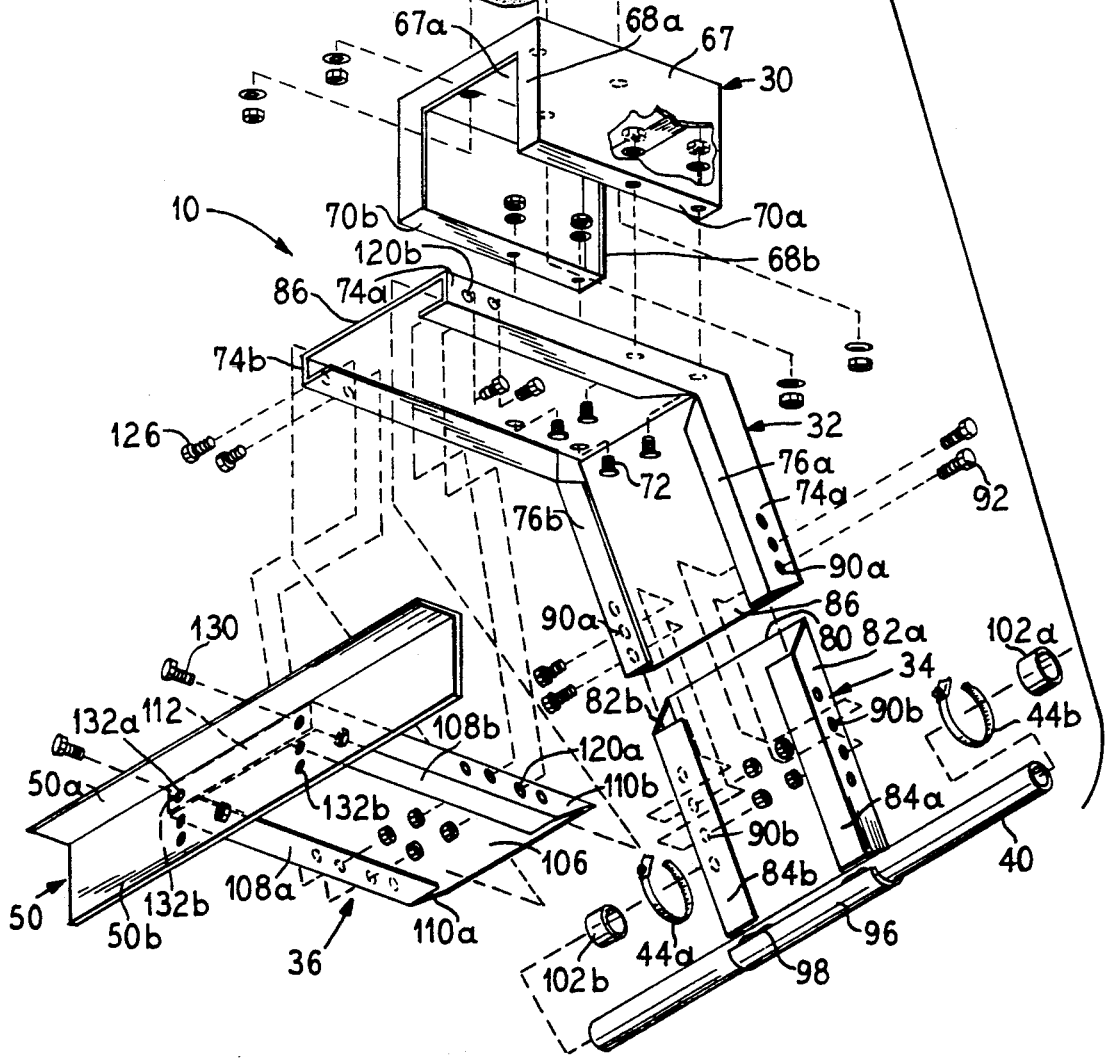
FIG. 3 is an exploded view of the seat assembly.

FIG. 3 shows the various components of the seat assembly of FIG. 1. The seat 26 is mounted to the pedestal 30 by a plurality of bolts 66. The pedestal 30 comprises a generally U-shaped structure 67 formed with U-shaped end walls 68*a*, 68*b* and bottom flanges 70*a*, 70*b*. The structure 67 provides a mounting wall 67*a* which holds the bolt 66. The bottom flanges 70*a*, 70*b* provide surface areas for bolt engagement with adjacent parts and also provide for bending and torsional rigidity of the pedestal 30. The end walls 68*a*, 68*b* provide for structural rigidity of the pedestal 30.

The pedestal 30 is bolted to the elbow plate 32 by bolts 72 through bottom flanges 70*a*, 70*b*. The elbow plate 32 comprises a slightly opened L-shaped configuration. The elbow plate 32 comprises side walls 74*a*, 74*b* and bottom legs 76*a*, 76*b*. The side walls 74*a*, 74*b* and the bottom legs 76*a*, 76*b* provide structural rigidity to the elbow plate and also provide structure for holding bolted connections.

A level adjusting plate 34 comprises a top plate 80, side plates 82*a*, 82*b*, and bottom walls 84*a*, 84*b*. The side plates 82*a*, 82*b* and the bottom walls 84*a*, 84*b* add structural rigidity to the level adjustment plate 34 as well as provide structure for holding bolted attachments. The level adjusting plate 34 fits telescopically inside the elbow plate 32, an overall outside distance between the side plates 82*a*, 82*b* being less than an inside clearance between the side walls 74*a*, 74*b*; and an overall distance between the top plate 80 and the bottom walls 84*a*, 84*b* is less than a clear distance between a cover plate 86 of the elbow plates 32 and the bottom legs 76*a*, 76*b*.

A plurality of holes 90*a* on the side wall 74*a*, 74*b* align with a plurality of cooperating holes 90*b* on the side plates 82*a*, 82*b*, wherein a plurality of bolts 92 are utilized to fasten the elbow plate 32 to the level adjustment plate 34. Although conceivably only one bolt 92 would be required, an excess number of holes 90*a* and/or 90*b* are provided to telescopically adjust the level adjustment plate 34 inside the elbow plate 32, bringing into select alignment a minimum number of holes 90*a*, 90*b* to secure the level adjustment plate 34 at the desired insertion of the level adjustment plate 34 into the elbow plate 32. In the exemplary embodiment illustrated four bolts 92 are used as shown.

The level adjustment plate 34 comprises at an end remote from the elbow plate a hook portion 96 which captures the stabilizing bar 40 therein. The stabilizing bar 40 can be welded such as at 98 to complete the connection. The stabilizing bar is a tubular member which holds on opposite ends resilient ring portions 102*a*, 102*b*. The resilient ring portions 102*a*, 102*b* act to form a slightly cushioned, gripping abutment to the boat, such as to the boat rib 42, 43, preventing scratching or denting of the boat, and the ring portions resiliently conform to irregularities in the boat surface to prevent play between the seat assembly 10 and the boat 20.

The length adjustment plate 36 is shown having a top wall 106, bottom flanges 108*a*, 108*b*, and side flanges 110*a*, 110*b*. In addition the length adjustment plate 36 has mounted at a remote end an abutment plate 112. The side flanges 110*a*, 110*b* and bottom flanges 108*a*, 108*b* and the abutment plate 112 all provide rigidity to the length adjustment plate, and the side flanges 110*a*, 110*b* and abutment plate 112 also provide structure for bolted attachments.

The length adjustment plate 36 is sized to insert telescopically into the elbow plate 32 at an end of the elbow plate 32 remote from the level adjusting plate 34. A clear distance between the side wall 74*a*, 74*b* is greater than an overall distance between the side flanges 110*a*, 110*b*; and a clear distance between the cover 86 and the bottom legs 76*a*, 76*b* is greater than an overall distance between the top wall 106 and the bottom flanges 108*a*, 108*b*. Thus, the length adjustment plate 36 is insertable into the elbow plate 32. A plurality of holes 120*a* through the side flanges 110*a*, 110*b* align with a plurality of cooperating holes 120*b* located in the side walls 74*a*, 74*b* when the length adjustment plate 36 is properly inserted into the elbow plate 32. A plurality of bolts 126 inserted through the holes 120*a*, 120*b* secure the length adjustment plate 36 to the elbow plate 32.

Although conceivably only one bolt 126 would be required, an excess number of holes 120*a* and/or 120*b* are provided to telescopically adjust the length adjustment plate 36 inside the elbow plate 32, bringing into select alignment a minimum number of holes 120*a*, 120*b* to secure the length adjustment plate 36 at the desired insertion of the length adjustment plate 36 into the elbow plate 32. In the preferred embodiment four bolts 126 are used as shown.

The abutment and support plate 50 is mounted to the front abutment plate 112 of the length adjustment plate 36 by bolts 130 inserted through a plurality of holes 132*a* in the vertical leg 50*b* of the abutment and support plate 50 cooperating with a plurality of holes 132*b* through the front abutment plate 112.

The plurality of holes 132*b* provide for a vertical adjustment of the abutment plate 112 with the abutment and support plate 50. The abutment and support plate 50 can be vertically shifted with respect to the abutment plate 112 to align a desired cooperating pair of holes 132*b* with a cooperating pair of holes 132*a* for insertion of the bolts 130. Thus, depending on the adjustments of the level adjustment plate 34 and the length adjustment plate 36 with respect to the elbow plate 32, the abutment and support plate 50 can be correspondingly adjusted to assure a proper elevation and tilt of the seat 26.

Although excess holes are provided throughout the invention for adjustments such as the holes 132*b*, 90*a*, 90*b*, 120*a*, 120*b*, the seat assembly could be manufactured with no holes or holes drilled in only one of two mating parts, and the seat assembly could be adjusted in a particular boat, in the field, and necessary holes drilled at that time. Thus, a minimum required amount of holes would be used to hold a minimum required amount of bolts.

Figure 4:
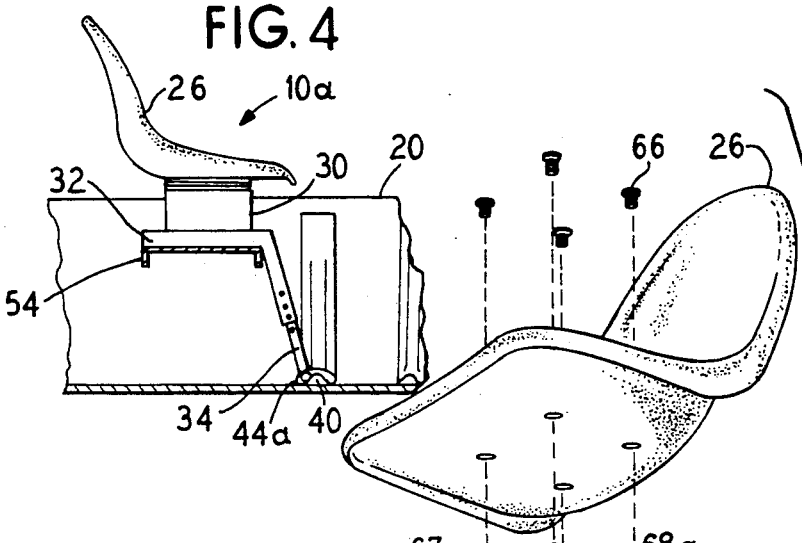
FIG. 4 is a sectional view of an alternate use of the seat assembly.

FIG. 4 shows an alternate utilization of the seat assembly wherein the abutment and support plate 50 is omitted. The seat 26 is reversed with respect to the pedestal 30 in this embodiment, although any orientation of the seat is encompassed by the present invention. The elbow plate 32 is connected to the level adjustment plate 34 as described above. The level adjustment plate 34 is connected by a plurality of hose clamps, such as 44*a* to a third rib 140. The elbow plate 32 is supported by the bench seat 54 to support the pedestal 30 directly above, and the seat 26 thereupon. The length adjustment plate 36 may or may not be needed depending on the distance between the third rib 140 and the bench seat 54.

Components of the seat assembly, such as the length adjustment plate 36, the elbow plate 30, the level adjustment plate 34, the pedestal 30, and the support and abutment plate 50 are preferably made of a strong galvanized steel or aluminum. The seat 26 can also be made of the aforementioned materials or a plastic material. Other materials can readily be used for the components of seat assembly and are within the scope of the present invention.

Although the present invention has been described with reference to a specific embodiment, those of skill in the art will recognize that changes may be made thereto without departing from the scope and spirit of the invention as set forth in the appended claims.

I claim as our invention:

1. A seat assembly for a small boat having a rib, comprising:

a seating platform;

an elbow frame supporting said seating platform, having a first leg portion arranged substantially horizontal, and a second leg portion arranged downwardly toward a bottom of the boat;

a level adjustment plate having a first end abutting the bottom of the boat and a second end mounted to said second leg portion, said level adjustment plate and said second leg portion mounted together at a connection which is selectively adjustable to select an overall length of said level adjustment plate and said second leg portion, to adjust an elevation of said first leg portion;

a length adjustment plate mounted at a first end to a bench seat of the boat, and mounted at a second end to said first leg portion, said length adjustment plate and said first leg portion selectively adjustably mounted together to selectively change an overall length of said first leg portion together with said length adjustment plate.

2. A seat assembly as defined in claim 1, wherein said level adjustment plate comprises a stabilizing bar portion mounted at said first end of said level adjustment plate, said stabilizing bar portion installed adjacent to the rib of the boat, and at least one hose clamp tieing said stabilizing bar to the rib.

3. A seat assembly as defined in claim 2, wherein said stabilizer bar portion comprises a straight bar with two free ends, a resilient ring mounted around each free end of said stabilizer bar, said resilient ring extending outwardly of said stabilizer bar and preventing contact between said level adjustment plate and said boat.

4. A seat assembly as defined in claim 2, wherein said length adjustment plate comprises at its said first end an abutment angle, said abutment angle having a first leg pressing down onto the bench seat, and a second leg arranged laterally and abutting the bench seat.

5. A seat assembly as defined in claim 4, wherein said seating platform comprises:

a pedestal mounted onto a top surface of said first leg portion, said pedestal providing a top elevation above an elevation of the bench seat;

and a seat having an integral back mounted onto a top surface of said pedestal.

6. A seat assembly as defined in claim 5, wherein said seat assembly further comprises means rotatably mounting said seat to said pedestal for rotation about an axis normal to said pedestal surface.

7. A seat assembly as defined in claim 1, wherein said length adjustment plate has a first cross-sectional shape and said first leg portion has a second cross-sectional shape, said first cross-sectional shape sized to be insertable into said second cross-sectional shape, such that said length adjustment plate is telescopically adjustably inserted within said first leg portion;

and said level adjustment plate has a third cross-sectional shape and said second leg has a fourth cross-sectional shape, said third cross-sectional shape sized to be insertable into said fourth cross-sectional shape such that said level adjustment plate is telescopically adjustably inserted within said second leg portion.

8. A seat assembly as defined in claim 7, wherein said first leg portion and said second leg portion comprise channel shaped cross sections with a first side wall and a second side wall, and said length adjustment plate comprises a channel shaped cross section having a first side flange and a second side flange, and said level adjustment plate comprises a channel shaped cross section having a third side flange and a fourth side flange, said first and second side flange of said length adjustment plate slidable within the area bounded by the first side wall and the second side wall, said first and second side flanges fastened to said first and second side walls at a selected position of said length adjustment plate within the first leg portion, said third and fourth side flanges slidably adjustable within said first and second side walls, said third and fourth side flanges fastened to said first and second side walls to adjustably locate said level adjustment plate within said second leg portion.

9. A seat assembly as defined in claim 8, wherein said assembly further comprises a first bolt and a second bolt, and wherein:

said first side wall and said second side wall have formed therein a plurality of axially arranged holes and disposed at both said first leg portion and said second leg portion;

and said first side flange and said second side flange comprise at least one corresponding hole each;

and said third side flange and said fourth side flange comprise at least one second corresponding hole each;

and when said level adjustment plate is telescopically inserted into said second leg portion said second corresponding hole is alignable with a plurality of said axially arranged holes, said first bolt selectively insertable into said aligned holes for fastening at a desired insertion of said level adjustment plate into said second leg portion;

and said corresponding hole is alignable with a plurality of said axially aligned holes of said first leg portion when said length adjustment plate is telescopically inserted into said first leg portion, said second bolt selectably insertable into said corresponding hole and a selected one of said axially arranged holes of said first leg portion for fastening said length adjustment plate to said first leg portion at a desired insertion of said length adjustment plate into said first leg portion.

10. A seat assembly as defined in claim 1, wherein said seat assembly further comprises a support and abutment plate mounted to said first end of said length adjustment plate and interposed between said length adjustment plate and the bench seat of the boat, said support and abutment plate comprising an angle shape with a first leg pressing down upon the bench seat, and a second leg laterally abutting the bench seat.

11. A seat assembly as defined in claim 10, and further characterized by vertically adjustable mounting means connecting said support and abutment plate to said length adjustment plate for vertical adjustability.

12. A seat assembly as defined in claim 1, wherein said elbow frame, said level adjustment plate, and said length adjustment plate are fashioned from folded metal plate.

13. A seat assembly as defined in claim 1, wherein said seating platform comprises a pedestal mounted onto a top surface of said first leg portion, said pedestal providing a top elevation above an elevation of the bench seat.

14. A seat assembly as defined in claim 1 wherein:

said seating platform is arranged elevated with respect to the bench seat;

said level adjustment plate has said first end secured to the bottom of the boat;

and said first portion is adapted to extend to and be simply supported on the bench seat of said boat at least at a free end of said first leg portion.

15. A seat assembly as defined in claim 1, wherein said level adjustment plate has a first cross-sectional shape and said second leg portion has a second cross-sectional shape, said first cross-sectional shape sized to be insertable into said second cross-sectional shape, such that said level adjustment plate is telescopically adjustably inserted within said second leg portion.

16. A seat assembly as defined in claim 15, wherein said elbow frame comprises a flat channel cross section and said level adjustment plate comprises a second flat channel cross section, said second flat channel cross section having a size slightly smaller than a size of said first flat channel cross section to slidingly fit therein, said second leg portion and said level adjustment plate having a plurality of alignable bolt holes for selectively fastening said level adjustment plate to said second leg portion at a desired position of telescopic insertion.

17. A seat assembly for a small boat having a bench seat, comprising:

a seating platform having a pedestal providing a seating surface elevated from the surface of the bench seat of the boat;

an elbow frame supporting said seating platform, having a first leg portion arranged substantially horizontal, and second leg portion arranged downwardly toward a bottom of the boat;

a level adjustment plate having a first end secured to the bottom of the boat and a second end mounted to said second leg portion, wherein said elbow frame comprises a first flat channel cross section and said level adjustment plate comprises a second flat channel cross section said second flat channel cross section having a size slightly smaller than a size of said first flat channel cross section to slidingly fit within said second leg portion telescopically, said second leg portion and said level adjustment plate having a plurality of alignable bolt holes for a selectively fastening said level adjustmeent plate to said second leg portion at a desired position of telescopic insertion of said level adjustment plate within said second leg portion;

and said first leg portion adapted to extend to, and be supported by, the bench seat of said boat at least at a free end of said first leg portion.

18. A seat assembly as defined in claim 17, wherein said first leg portion has means for adjusting a length of said first leg portion.

19. A seat assembly as defined in claim 18, wherein said pedestal further comprises a seat rotatably attached to said seating surface, rotatable about an axis normal to said seating surface.

* * * * *